US005913571A

United States Patent [19]

Dystra et al.

[11] Patent Number: 5,913,571

[45] Date of Patent: Jun. 22, 1999

[54] MARINE SEATING APPARATUS

[75] Inventors: Daniel R. Dystra, Wales; David W. Windstein, Pewaukee, both of Wis.

[73] Assignee: Outboard Marine Corporation, Waukegan, Ill.

[21] Appl. No.: 08/937,686

[22] Filed: Sep. 29, 1997

[51] Int. Cl.[6] ..... A47C 7/02

[52] U.S. Cl. ..... 297/452.12; 297/423.28; 297/188.1; 297/440.12

[58] Field of Search ..... 297/423.28, 188.1, 297/188.09, 188.08, 326, 354.11, 440.1, 440.12, DIG. 1, 118, 423.3, 423.1, 382, 30, 423.27, 17, 451.11, 451.12; 248/152, 174

[56] References Cited

U.S. PATENT DOCUMENTS

| | | | |
|---|---|---|---|
| 241,748 | 5/1881 | Strauss . | |
| 1,843,814 | 2/1932 | Hallowell et al. . | |
| 2,806,514 | 9/1957 | Smith | 297/440.12 |
| 3,312,503 | 4/1967 | Suzuki . | |
| 3,331,634 | 7/1967 | Harrison, Jr. . | |
| 3,422,938 | 1/1969 | Worcester . | |
| 3,627,086 | 12/1971 | Caigan . | |
| 4,085,970 | 4/1978 | Klein . | |
| 4,567,845 | 2/1986 | Smith . | |
| 4,637,081 | 1/1987 | Clark . | |
| 4,693,204 | 9/1987 | Klein . | |
| 4,738,217 | 4/1988 | Smith . | |
| 4,826,242 | 5/1989 | Tretheway . | |
| 4,875,737 | 10/1989 | Cardenas . | |
| 4,919,068 | 4/1990 | Lathers . | |
| 5,190,350 | 3/1993 | Hwang et al. . | |
| 5,252,373 | 10/1993 | Ganske et al. . | |
| 5,408,710 | 4/1995 | Garman et al. . | |

OTHER PUBLICATIONS

*Introduction to Optics,* Pedrotti, et al., "Two–Layer Antireflecting Films," Sec. 22–3, Prentice–Hall, Inc. 1987.

*Primary Examiner*—Milton Nelson, Jr.
*Attorney, Agent, or Firm*—Jones, Day, Reavis & Pogue

[57] ABSTRACT

A seating apparatus for a boat comprising a one piece base to which is affixed a seat. The seat has a back portion divided into two parts, lower and upper, by a living hinge and a bench portion. In another embodiment a footrest portion is also included. In that embodiment, the footrest and bench portions are integrally formed and are separated by another living hinge. The seating apparatus is simply constructed of a sandwich material with outer layers comprising polyethylene and a core comprising foam. The seating apparatus is also easy to use and may be moved quickly and easily between a bench style configuration and a lounge configuration.

9 Claims, 2 Drawing Sheets

MARINE SEATING APPARATUS

BACKGROUND OF THE INVENTION

1. Field of the Invention

The present invention relates to a seating apparatus and, more particularly, to a marine seating apparatus which is simply constructed, inexpensive, easy to use and effective. The marine seating apparatus may be easily converted from a bench type seat into a lounge type seat.

2. Description of the Related Art

Currently, marine seating devices, such as those on pontoon boat decks comprises pressure-treated plywood. The treated wood is usually formed into a seating device having a back, a bench and, perhaps, a lounge portion. These seating devices are typically equipped with metal hinges to allow parts to be rotated and to provide a storage space or to transform the seating device into a different form such as a sleeping surface.

There are, however, a number of problems with these seating designs. For example, such seating devices are formed from a large number of parts, including fasteners, corner blocks, metal hinges and metal tracks. Another problem is that the mechanisms for folding such lounge seating devices operate awkwardly; they are difficult to move and they may require excessive force to open and close. Examples of complicated seating devices may be seen by referring to two earlier U.S. Pat. Nos. 4,738,217 and 4,637,081.

Yet another problem with the prior art is that pressure treated plywood is water absorbent. This greatly increases the weight of the seating device over a period of time and it also contributes to decay and delamination even after just a few years of exposure. Still a further problem is that pressure treated plywood is considered to be a hazardous waste product in some locations thereby causing disposal problems for boat owners with old seating devices and for seating manufacturers who must dispose of scrap material from the manufacturing process.

While different types of seating devices have been patented in the past indicating numerous prior attempts to provide a better marine seating structure, these attempts have yet to produce an optimal system.

BRIEF DESCRIPTION OF THE INVENTION

The difficulties encountered by previous systems have been overcome by the present invention. What is described here is a seating apparatus comprising a base for supporting a seat, a seat connected to the base having a back portion, a bench portion, a footrest portion, and first and second living hinges, wherein the first living hinge is located in the back portion and the second living hinge separates the bench portion from the footrest portion.

An object of the present invention is to provide a seating apparatus which is simply constructed and relatively inexpensive. A related aspect of the present invention is to provide a seating apparatus with few parts. Another aim of the present invention is to provide a marine seating apparatus that easily converts from a lounge type seat to a bench type seat. Still another advantage of the present invention is to provide a seating apparatus which uses more efficient plastic marine board. Because pressure treated plywood absorbs water which increases its weight over time, and because pressure treated plywood rapidly decays or delaminates after a few years of exposure, it is an aspect of the present invention to avoid the use of pressure treated plywood. Pressure treated plywood is also considered a hazardous waste product and, therefor, an advantage of the present invention is the avoidance of its use. In contrast, plastic marine board is light weight, low cost and recyclable.

A more complete understanding of the present invention and other objects, aspects, aims and advantages thereof will be gained from a consideration of the following description of the preferred embodiments read in conjunction with the accompanying drawings provided herein.

DESCRIPTION OF THE PREFERRED EMBODIMENTS

Figure 1:
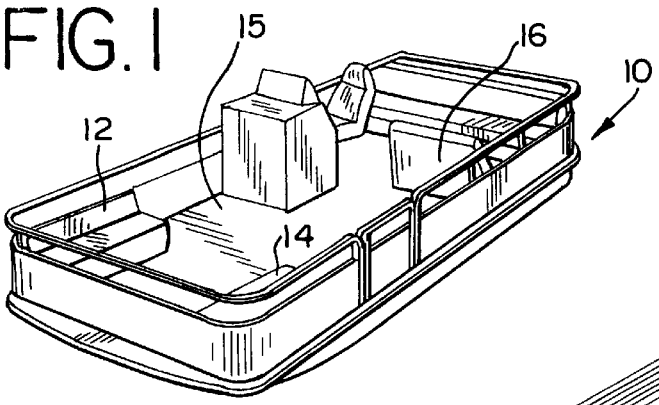
FIG. 1 is a perspective view of a pontoon boat showing several seating apparatus of the present invention.

While the present invention is open to various modifications and alternative constructions, the preferred embodiments as shown in the drawings will be described herein in detail. It is to be understood, however, that there is no intention to limit the invention to the particular forms disclosed. On the contrary, the intention is to cover all modifications, equivalents and alternatives falling within the spirit and scope of the invention as expressed in the appended claims.

Referring now to FIG. 1, there is illustrated a pontoon boat 10 having three seating apparatus 12, 14 and 16 located around the deck 15 of the boat. While a pontoon boat is shown and described, the seating apparatus of the present invention may be used on other boat types and even on other vehicles. In fact, the seating apparatus may be used in any suitable environment, such as on the front porch of a house or even in the interior of the house.

Figure 2:
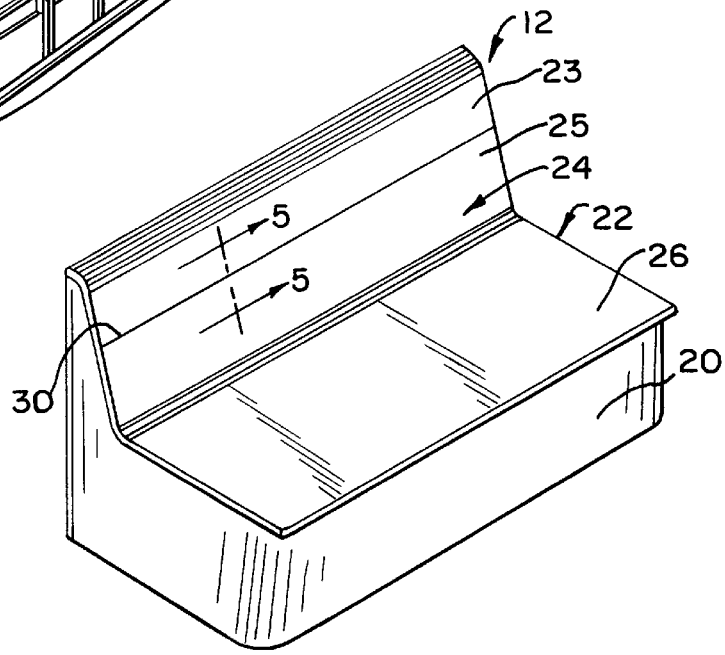
FIG. 2 is an enlarged perspective view of one of the seating apparatus of FIG. 1.
Figure 11:
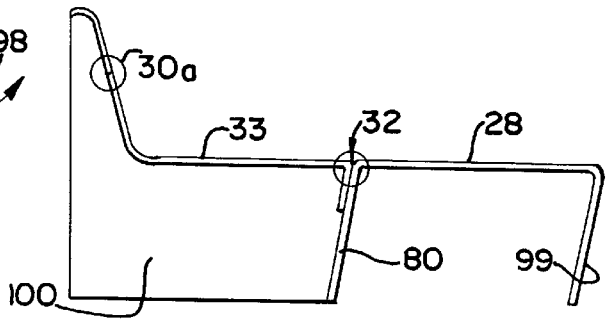
FIG. 11 is a diagrammatic elevational view showing the seating apparatus of FIG. 7 transformed into a lounge-type seating apparatus.

Referring now to FIG. 2, one of the seating apparatus 12 is illustrated in an enlarged view. The seating apparatus 12 includes a base 20 and a seat 22. The seat, in turn, includes a back portion 24, having an upper part 23 and a lower part 25, and a bench portion 26. In some variations, a footrest portion 28, FIG. 7 may also be present. As shown in FIGS. 2 and 11 the back portion extends in a generally upward direction from the bench portion. The two back portion parts 23, 25 are aligned in a generally planar configuration to form a back rest.

In addition to the various portions, the seating apparatus of FIG. 2 also includes a living hinge 30 which divides the back portion into the upper and lower parts. In the FIG. 7 embodiment, a second living hinge 32 is provided for separating a bench portion 33 from the footrest portion 28. Living hinges may be defined as a hinge formed integral with the surrounding material but with a reduced cross-section or reduced thickness so as to provide greater flexibility than the surround material. This allows the material to bend in response to a relatively small force. The living hinge 30 is designated by a line in FIG. 2 and is at the center of circles in the diagrammatic views, FIGS. 6–11. In a similar manner, the living hinge 32 is a bend in the center of a circle in each of the diagrammatic views, FIGS. 7–11.

Figure 3:
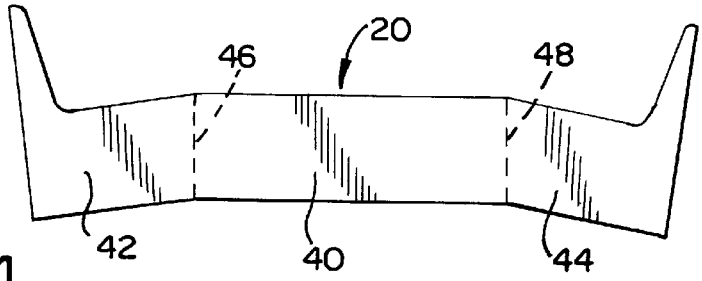
FIG. 3 is an elevational view of the base portion of the seating apparatus shown in FIG. 2 illustrating the base portion in a flattened condition before being formed into the configuration shown in FIG. 2.
Figure 4:
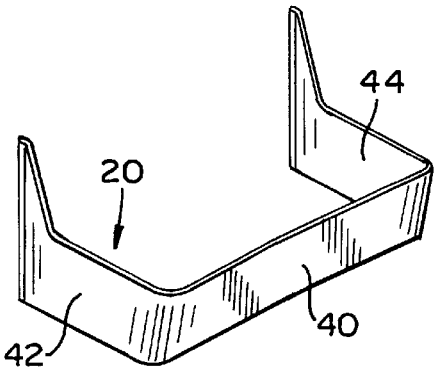
FIG. 4 is a perspective view of the base portion of FIG. 3 shown in a formed position.

The simple construction and inexpensive design of the present invention can begin to be appreciated by reference to FIGS. 3 and 4. There the base is shown in two different views. In FIG. 3, the base is illustrated in a sheet or flattened condition as it would appear if the base was cut from a sheet of material and then folded to achieve the geometry shown in FIG. 4. The base includes a front 40, a left arm 42 and a right arm 44. A first fold or bend, represented by dotted line 46, is shown between the front 40 and the left arm 42. A second fold or bend is represented by the dotted line 48 located between the front 40 and the right arm 44. As may be appreciated, during construction the peripheral shape of the base is formed by a cutting or stamping operation; the left and right arms are each bent 90 degrees relative to the front. This achieves the geometry shown in FIG. 4. As will be explained below, the material is a synthetic resin/foam which may be cut, heated and bent using well-known techniques. In the alternative, the base may be molded in the shape shown in FIG. 4, if desired.

Figure 5:
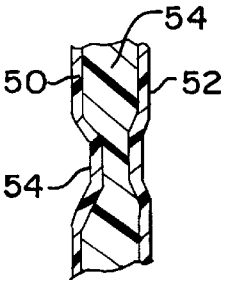
FIG. 5 is an enlarged partial sectional view taken along line 5—5 of FIG. 2.

The simplicity of the invention and its advantages against deterioration may be appreciated by referring now to FIG. 5. The material of the seating apparatus is called "marine board" which is comprised of a sandwich with two polyethylene outer layers 50 and 52, and a core 54 of foam material. This provides a light but strong structure which is resistant to water damage, water absorption, rotting, delamination and decay. Other suitable thermal plastic materials may also be. The particular sandwich structure described above may be purchased from Otron Technology of Wallaceburg, Ontario, Canada under the brand name KEL-RON. The seating apparatus with its back portion, bench portion and, perhaps, footrest portion may be constructed of a three-quarter inch thick panel. The base may be constructed of a one-half inch thick panel. A living hinge 54, diagrammatically shown in FIG. 5, is formed by applying heat and pressure at the desired location to reduce the thickness of the panel at that location. Fasteners, such as screws, or welding may be used to connect or attach the seat to the base.

Figure 6:
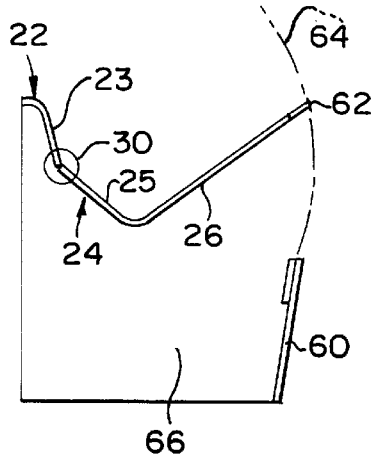
FIG. 6 is a diagrammatic elevational view of the seating apparatus of the present invention showing the seating apparatus of FIG. 2 in a partially raised position.
Figure 7:
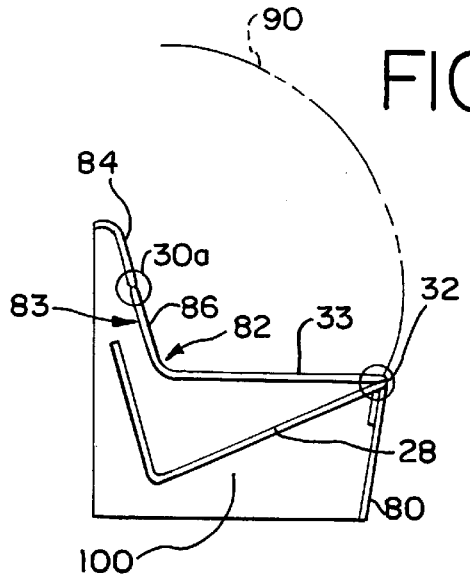
FIG. 7 is a diagrammatic elevational view of a lounge-type seating apparatus of the present invention which has been folded bench-style.

The advantage of having few parts is best shown by reference to FIGS. 6 and 7. These Figures also highlight the ease of use of the seating apparatus. In one embodiment, shown in FIG. 6, the seating apparatus includes two parts, the base 60 and the seat 22. The back portion 24 is divided into the upper back part 23 and the lower back part 25. These parts are divided by the living hinge 30. It is noted that the upper back part and the lower back part may be rotated relative to each other at the living hinge. The bench portion has an extended edge 62 which is movable along an arc represented by a phantom line 64 when there is rotation about the hinge. The lower back part 25 and the bench portion 26 pivot or rotate relative to the upper back part 23 which is fixed to the base 60. Providing rotation allows for an accessible storage chamber 66 to be formed and defined between the seat and the base.

Another embodiment of the present invention is shown in FIGS. 7–11. The seating apparatus includes a base 80, a seat 82, a back portion 83 having an upper part 84 and a lower part 86, the bench portion 33 and the footrest portion 28. Between the upper and lower back parts is a living hinge within the circle 30*a* and between the bench portion and the footrest portion is the second living hinge within the circle 32. A phantom line 90 represents the arc traveled by the second living hinge 32 when the seat is transformed from a bench-type configuration to a lounge-type configuration.

Figure 8:
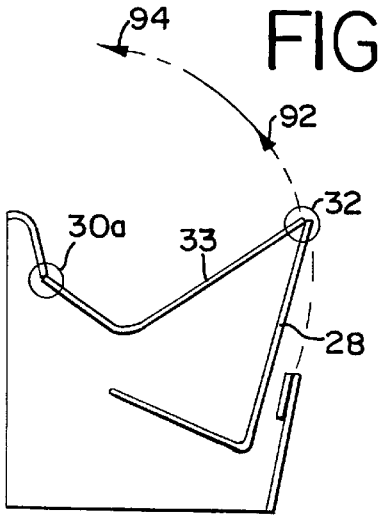
FIG. 8 is a diagrammatic elevational view showing the seating apparatus of FIG. 7 in the initial stage of transformation from a bench-type seating apparatus to a lounge-type seating apparatus.
Figure 9:
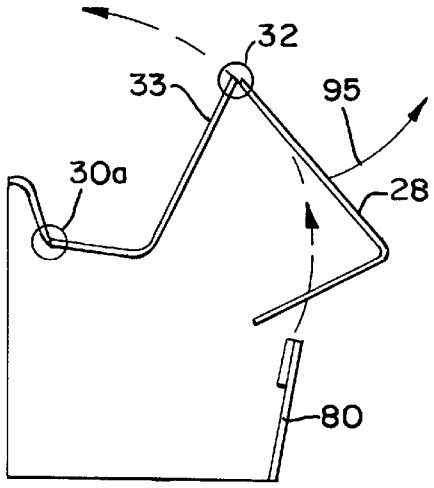
FIG. 9 is a diagrammatic elevational view showing the seating apparatus of FIG. 7 at a slightly later time in the transformation from a bench-type seating apparatus to a lounge-type seating apparatus.
Figure 10:
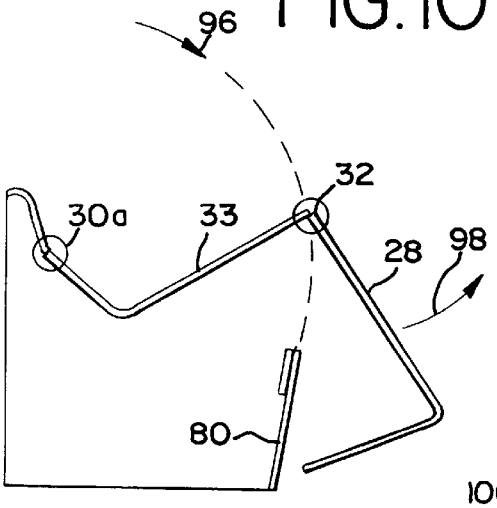
FIG. 10 is a diagrammatic elevational view showing the seating apparatus of FIG. 7 nearly in a completed transformation from a bench-type seating apparatus to a lounge-type seating apparatus.

The ease of use of the apparatus may be appreciated by the transformation illustrated in the FIGS. 7–11. There the seating apparatus moves from the bench-style configuration of FIG. 7 to the lounge-style configuration of FIG. 11. In FIG. 8, the bench portion is shown rotating counterclockwise about the living hinge 30*a* in a direction symbolized by the arrows 92 and 94. The footrest portion also begins a counterclockwise rotation about the hinge 32. In FIG. 9, the bench portion has nearly completed the upward counterclockwise rotation about the hinge 30*a*. At the same time, the footrest portion 28 continues rotating in a counterclockwise direction about the hinge 32 in the direction symbolized by the arrow 95. FIG. 10 depicts the bench portion 33 pivoting or rotating in the opposite direction, clockwise, as shown by the arrow 96 around the hinge 30*a*. At the same time the footrest portion 28, continues to pivot counterclockwise as symbolized by the arrow 98, so that the lounge configuration of FIG. 11 is reached when the living hinge 32 abuts the base 80. Downward movement of the bench portion 33 and footrest portion 28 is restricted by the base so that the bench portion and the footrest portion are generally in an alignment typical of a lounge chair. The footrest portion is also supported by a leg 99.

In the movement just described, the back parts rotate approximately 65 degrees relative to one another about hinge 30*a*. The bench and footrest portions, however, rotate about 155 degrees relative to one another. In the lounge configuration a limited storage chamber 100 is formed between the seat and the base.

If it is desired to transform the seat from the lounge style of FIG. 11 to the bench style of FIG. 7, the process just described is reversed. Starting in the configuration shown in FIG. 11, the hinge 32 is moved upwardly, rotating counterclockwise about hinge 30*a*. At the same time the footrest portion rotates downwardly relative to the bench portion (clockwise about hinge 32) to achieve the configuration shown in FIG. 10. The bench portion 33 continues to pivot counterclockwise around the hinge 30*a* until the footrest portion 28 clears the base 80 (as shown in FIG. 9) whereupon the foot rest portion may be tucked under the bench portion by continuing to rotate these two portions relative to each other about the hinge 32 to reach the configuration shown in FIG. 8. At the same time, the bench portion rotates downwardly or clockwise around hinge 30*a*. When the bench portion abuts the base, as shown in FIG. 7, the footrest is located within the enclosure 100 and a bench-type configuration is achieved.

The movement just described, transforming the seating apparatus from a bench-style to a lounge-style configuration or transforming the seating apparatus from a lounge-style to a bench-style configuration, can be easily accomplished by gripping the bench portion with one hand and, after exposure of the footrest portion, gripping the footrest portion with the other hand. The movements are easy, natural and intuitive.

A latch (not shown) may be provided to maintain the geometry of the bench and footrest portions shown in FIG. 7 until an operator deems it efficacious to release the latch. The base may be designed to facilitate abutment with the seat and to allow sliding engagement with the footrest so that no damage results. If desired, handholds may be provided.

The specification describes in detail several embodiments of the present invention. Other modifications and variations will, under the doctrine of equivalents, come within the scope of the appended claims. For example, different materials might be used; the angles between the back and the bench may be altered; dimensions may vary and additional living hinges may be provided. Other equivalent structures include concave bench portions, different slants of the back portion and a shorter leg on the footrest. Still other alternatives will also be equivalent, as will many new technologies. There is no desire or intention here to limit in any way the application of the doctrine of equivalents.

We claim:

1. A seating apparatus comprising:

a base for supporting a seat;

a seat connected to said base having a back portion, a bench portion, a footrest portion and first and second living hinges, wherein said first living hinge is located in said back portion and said second living hinge separates said bench portion from said footrest portion, said back portion extending in a generally upward direction from said bench portion, said first living hinge being generally disposed in a horizontal direction causing said back portion to be divided into two parts, said two parts being in a generally planar configuration.

2. An apparatus as claimed in claim 1 wherein:

said base includes two side portions integral with a front portion.

3. An apparatus as claimed in claim 1 wherein:

said seat is formed of a sandwich of thermoplastic materials.

4. An apparatus as claimed in claim 3 wherein:

said thermal plastic sandwich comprises outer layers of polyethylene and an inner layer of foam.

5. An apparatus as claimed in claim 1 wherein:

said seat is transformable between bench and lounge configurations.

6. An apparatus as claimed in claim 5 wherein:

said first hinge rotates through approximately 65 degrees and said second hinge rotates through approximately 155 degrees when said seat moves between bench and lounge configurations.

7. An apparatus as claim in claim 5 wherein:

said first and second hinges rotate in the same direction when said seat is transformed between configurations.

8. An apparatus as claimed in claim 5 wherein:

said footrest portion rotates around said second hinge to move between two positions, one position where said footrest portion is generally aligned with said bench portion and another position where said footrest portion is tucked under said bench portion.

9. An apparatus as claimed in claim 8 wherein:

said back portion pivots about said first hinge when said footrest portion moves between said one and said other positions.

* * * * *